US006058513A

United States Patent [19]

Simmons et al.

[11] Patent Number: 6,058,513

[45] Date of Patent: May 9, 2000

[54] WEARABLE BELT SUPPORT DEVICE FOR ASSISTING A HANDICAPPED INDIVIDUAL

[75] Inventors: Jesse K. Simmons; Maralyne J. Simmons, both of Milford, Mich.

[73] Assignee: KBM Company, Farmington Hills, Mich.

[21] Appl. No.: 09/152,806

[22] Filed: Sep. 14, 1998

[51] Int. Cl.[7] ..... A41F 3/00

[52] U.S. Cl. ..... 2/312; 2/44

[58] Field of Search ..... 2/311, 44, 308, 2/312, 468, 60, 300, 336; D2/627, 629; 414/921; 182/3; 119/856, 792; 224/160, 163, 184

[56] References Cited

U.S. PATENT DOCUMENTS

| | | | |
|---|---|---|---|
| 1,271,176 | 7/1918 | Kureczka | 224/160 |
| 3,487,474 | 1/1970 | De Meo | 2/311 |
| 3,564,616 | 2/1971 | Battaglia | 2/311 |
| 3,840,902 | 10/1974 | McNeill . | |
| 3,896,499 | 7/1975 | Kelly . | |
| 3,940,801 | 3/1976 | Riggs et al. | 2/311 |
| 4,028,742 | 6/1977 | Marquis . | |
| 4,172,292 | 10/1979 | Horton . | |
| 4,396,013 | 8/1983 | Hasslinger . | |
| 4,411,222 | 10/1983 | Wolfson | 2/300 |
| 4,413,358 | 11/1983 | Jimenez | 2/321 |
| 4,429,419 | 2/1984 | Snyder . | |
| 4,560,097 | 12/1985 | Reynolds et al. . | |
| 4,625,334 | 12/1986 | Proffer . | |
| 5,036,549 | 8/1991 | Jackson . | |
| 5,038,779 | 8/1991 | Barry et al. . | |
| 5,081,719 | 1/1992 | Donnelly . | |
| 5,152,013 | 10/1992 | Johnson . | |
| 5,619,751 | 4/1997 | Ray et al. . | |
| 5,718,189 | 2/1998 | Blake | 119/770 |
| 5,806,087 | 9/1998 | Grotefend | 2/1 |

*Primary Examiner*—John J. Calvert
*Assistant Examiner*—Alissa L. Hoey
*Attorney, Agent, or Firm*—Gifford, Krass, Groh, Sprinkle, Anderson & Citkowski, P.C.

[57] ABSTRACT

A wearable belt support device for use in assisting a handicapped individual including a first looped portion encircling a waist of an assisting individual and having a first interengaging end and a second interengaging end. At least one and preferably two hand hold portions are provided at first and second selected sides of the first looped portion and are capable of being grasped by an assisted individual. The device further includes a second shoulder strap portion extending upwardly from the first looped portion and capable of being resecurably attached at first and second ends to the first looped portion. An optional third neck support portion encircles a neck of the assisting individual and a connecting portion extends from the neck support portion and engages an intermediate location along the second shoulder strap portion.

14 Claims, 1 Drawing Sheet

WEARABLE BELT SUPPORT DEVICE FOR ASSISTING A HANDICAPPED INDIVIDUAL

BACKGROUND OF THE INVENTION

1. Field of the Invention

The present invention relates generally to wearable belt support devices and, more particularly, to a belt support device capable of being worn by an individual assisting a handicapped or physically challenged person.

2. Description of the Prior Art

The prior art is well documented with types of belt support devices for use by a riding passenger on such propelled vehicles as motorcycles, snow mobiles or water craft and in which the passenger rides in a rear tandem arrangement relative to a driver and would not otherwise have a suitable hand hold support for preventing from falling off. An example of such a support device is illustrated in U.S. Pat. No. 5,619,751, issued to Ray et al., which discloses a marine safety vest designed to be worn by an operator of a personal watercraft and which includes a pair of handles attached to the waist section at the sides of the operator. An additional example of such support devices is shown in U.S. Pat. No. 3,896,499, issued to Kelly, which teaches a belt device suitable for a tandem riding passenger on a snow mobile. Examples of additional support devices for use with motorcycle passengers are shown in U.S. Pat. No. 5,152,013, issued to Johnson, U.S. Pat. No. 5,081,719, issued to Donnelly, and U.S. Pat. No. 3,840,902, issued to McNeill.

Additional prior art is known in the area of a providing a belt support device for assisting a medically challenged individual in ambulatory movement. An example is illustrated in U.S. Pat. No. 4,396,013, issued to Hasslinger, which teaches a support and guide strap for encircling securement about the midsection of an individual and which includes first and second engaging elements of a VELCRO construction. The support and guide strap further includes a pair of handles located in a spaced apart arrangement on a rear side of the strap once it has been mounted about the assisted individual's midsection. An attendant assists both supporting and guiding movement of the assisted individual by grasping the rear positioned straps.

SUMMARY OF THE PRESENT INVENTION

The present invention is a wearable belt support device worn by an assisting individual and for use in aiding a handicapped individual in ambulatory movement. The belt support device includes a first looped portion which is preferably constructed of a suitable flexible leather or vinyl material. The first looped portion includes first and second interengaging ends and width adjustment means in the form of VELCRO attachments for firmly securing the first looped portion around the assisting individual's waist. At least one and preferably two hand hold portions are provided and are located at opposite sides of the first looped portion. As will be further described, it is contemplated that an assisted individual will grasp one of the selected hand hold portions during the provision of ambulatory support by the assisting individual.

A second shoulder strap portion extends upwardly from the first looped portion and over a shoulder of the assisting individual. The shoulder strap portion secures at first and second ends to selected locations along the first looped portion, typically on the front and rear, respectively, and towards either the right or left side of the individual. In a preferred embodiment, the shoulder strap portion is provided as first and second interconnected and elongate sections and likewise includes interengaging ends to facilitate the height adjustment of the shoulder strap to fit the wearer.

A third neck support portion is employed in certain embodiments and includes an encircling portion with interengaging ends and a connecting portion which extends from the encircling portion and attaches to an intermediate location of the second shoulder strap portion in a releasably securable manner. In a further embodiment, the shoulder strap portion is capable of being detachable at its first and second ends from a selected one of the right or left sides of the first looped portion and resecurably attached at the opposite side to facilitate the support of the device on either side of the assisting individual.

BRIEF DESCRIPTION OF THE DRAWINGS

Reference will now be made to the accompanying drawings, when read in combination with the following specification, wherein like reference numerals refer to like parts throughout the several views, and in which.

DETAILED DESCRIPTION OF THE PREFERRED EMBODIMENTS

Figure 1:
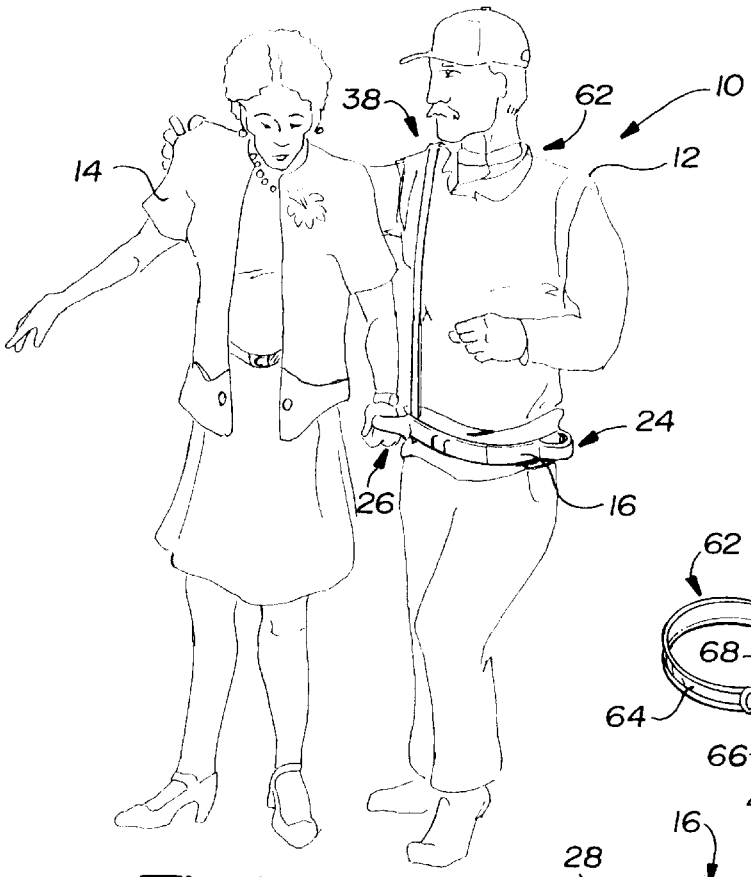
FIG. 1 is an environmental view showing the wearable belt support device according to a first preferred embodiment of the present invention secured upon an assisting individual and illustrating the manner in which it is employed in assisting the ambulatory movement of an assisted individual.
Figure 2:
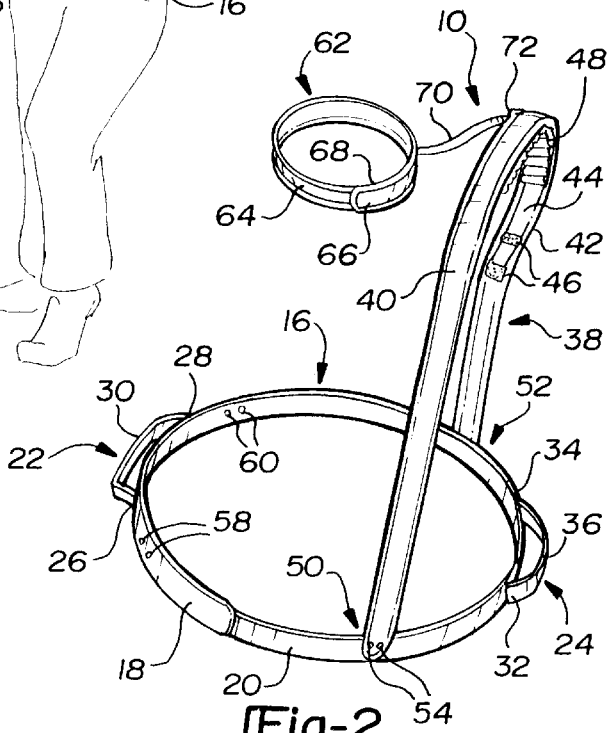
FIG. 2 is a perspective view of the wearable belt support device as illustrated in FIG. 1.

Referring now to FIGS. 1 and 2, a wearable belt support device is illustrated at 10 according to a first preferred embodiment of the present invention. The belt support device 10 is worn by an assisting individual 12 for the purpose of facilitating the ability of that individual 12 to provide ambulatory support to a physically challenged individual 14. The belt 10 is typically constructed of a flexible yet resilient material such as a leather or vinyl. However it is understood that the belt may also be constructed of any other suitable type of material which exhibits the necessary properties.

The belt 10 includes a first looped portion 16 which encircles the waist of the assisting individual. The first looped portion 16 includes a first interengaging end 18 and a second interengaging end 20 which in combination establish a width adjustment means for firmly fitting the first looped portion 16 around the waist of the assisting individual. The first and second interengaging ends 18 and 20 are typically provided as interengaging strips of VELCRO material as are known in the art and which permit the first end 18 to be selectively located along the second end 20. It is also understood that other types of conventional interengaging means may also be employed, among these including belt apertures and receiving hooks located on the respective ends (not shown).

A first hand hold portion 22 and a second hand hold portion 24 are provided and extend from opposite sides of the first looped portion 16. Each of the hand hold portions 22 and 24 are constructed as horizontally extending and outwardly bulging portions which secure at opposite ends to the first looped portion 16. Specifically, the first hand hold portion 22 secures at ends 26 and 28 to a first selected side (left side) of the looped portion 16 and includes an outwardly bulging middle 30. Likewise, the second hand hold portion 24 secures at ends 32 and 34 to an opposite selected side (right side) of the looped portion 16 and includes an outwardly bulging middle 36. The horizontal running lengths of the hand hold portions 22 and 24 are optimally six inches in length, however it is understood that other lengths may be provided without departing from the scope of the instant invention. The purpose of the hand hold portions 22 and 24 is to provide the assisted individual 14 with a suitable hand hold extending from the general belt area of the assisting individual 12, it having been found that the location and existence of such a hand hold provides an optimal level of ambulatory support to the assisted individual 14 while at the same time providing a higher degree of convenience to the assisting individual 12. It is also understood that further preferred embodiments of the present invention may employ only one of the hand holds 22 and 24 without departing from the scope of the instant invention.

A second shoulder strap portion 38 extends upwardly from the first looped portion 16 and over a shoulder of the assisting individual 12. The shoulder strap portion 38 in the preferred embodiment includes a first elongate section 40 and a second elongate section 42. Height adjustment means are provided in the form of an interiorly configured and trailing strap portion 44 of the first elongate section which is received through inwardly projecting receiving loops 46 configured along the inner surface of the second elongate section 42. In cooperation with or in place of the strap 44 and loops 46 may be provided additional VELCRO portions for selectively interengaging a first trailing end of the first elongate section 40 (again strap 44) along an intermediate section (loops 46) of the second elongate section 42. According to additional preferred embodiments, interengaging or VELCRO adjustment means may also be provided separately on both the front and rear of the shoulder strap portion 38. Also, padded portions 48 may be provided on an interiorly facing surface of the overlapping connection of the elongate sections 40 and 42, such as along an upper looped end of the shoulder strap 38 corresponding with the area of engagement with the assisting individual's shoulder (see again FIG. 1).

Referring again to FIG. 2, means for securing the shoulder strap 38 at first and second ends 50 and 52 of the first looped portion 16 are provided and include, in a preferred embodiment, the provision of snap engagement portions 54 situated upon the strap 38 at the first end 50 and in identical fashion upon the second end 52 (hidden from view in the illustrations). The snap engagement portions 54 mate with snap receiving portions arrayed at the desired circumferential locations upon the first looped portion 16 and which are again hidden for ends 50 and 52 along the left selected side of the looped portion 16 in FIG. 2. Additional snap receiving portions for the first looped portion 16 are however illustrated corresponding to the right side and are shown at 58 and 60. The purpose of the snap engagement portions and snap receiving portions is to facilitate movement of the shoulder strap portion 38 from one side of the looped portion 16 to the other to facilitate the ambulatory assistance of the assisted individual 14 depending upon the particular infirmity of the individual 14 and the convenience of the assisting individual 12. It is again understood that other and different kinds of interengaging means, in the stead of snap engaging and receiving portions, may be employed for resecurably attaching the shoulder strap portion to the looped portion.

Referring again to FIG. 2, a third neck support portion 62 is illustrated and which is capable of encircling the neck of the assisting individual 12. The neck support portion 62 includes an elongate strap portion 64 having a first interengaging end 66 and a second interengaging end 68. Adjustment means are provided for locating the first end 66 at selected locations along the second end 68 and typically again consist of VELCRO interattachment or other conventionally known and suitable engagement portions. A connecting portion 70 also extends from a selected location along the neck support portion 62 and is resecurably attachable to the shoulder strap portion 38 at 72 (again by VELCRO means or other attachment means known in the art). The purpose of the neck support portion 62 is to provide additional locating support to the shoulder strap portion 38 to prevent the upper looped end from falling off the assisting individual's shoulder during use and to do so without applying any appreciable degree of pulling force to the individual's neck.

Figure 3:
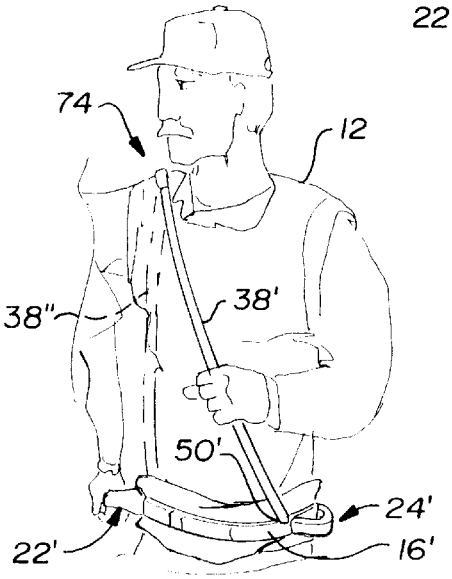
FIG. 3 is view similar to that shown in FIG. 1 and illustrating the wearable belt support device according to a second preferred embodiment of the present invention.

Referring now to FIG. 3, a further preferred variant of the present invention is illustrated at 74 of the wearable belt support device and is identical in most respects to the first preferred embodiment, with the exception that shoulder strap portion, indicated at 38', extends in a generally diagonal fashion from the first looped portion 16' at the first end 50' of the left side and loops over the right shoulder of the assisting individual 12 before reattaching at the rear or second end (hidden from view) of the first looped portion 16' and again at its left side. The second shoulder strap portion is again illustrated at 38" and is suitable for engaging the right side of the first looped portion 16' at forward and rearward locations as is also disclosed in FIGS. 1 and 2 and without departing from the scope of the instant invention.

An additional preferred embodiment contemplates the wearable belt support device being used by a parent to assist in keeping a child in close proximity while the parent is occupied with other tasks.

Having described our invention, it will become apparent that other and additional preferred embodiments will become apparent to those skilled in the art to which it pertains and without deviating from the scope of the appended claims.

We claim:

1. A wearable belt support device worn by an individual assisting a handicapped individual, said support device comprising:

a looped portion encircling a waist of an assisting individual, said looped portion including a width adjustment means;

at least one hand hold portion extending from a selected circumferential location along said looped portion; and a shoulder strap portion extending upwardly from said looped portion and over a shoulder of the assisting individual, said shoulder strap portion securing at first and second ends to further selected circumferential locations along said looped portion, said shoulder strap portion including a height adjustment means;

wherein said hand hold portion is grasped by an assisted individual to facilitate the assisting individual in providing ambulatory support.

2. The wearable belt support device according to claim 1, said looped portion further comprising a first interengaging end and a second interengaging end, said width adjustment means further including means for selectively locating said first interengaging end at specified locations along said second interengaging end.

3. The wearable belt support device according to claim 2, said shoulder strap portion further comprising a first elongate section and a second interconnected elongate section, said height adjustment means further including means for selectively locating an end of said first elongate section at specified locations along said second elongate section.

4. The wearable belt support device according to claim 1, said at least one hand hold portion further comprising a horizontally extending and outwardly projecting handle including first and second ends securing to said looped portion.

5. The wearable belt support device according to claim 4, said at least one hand hold portion further comprising a first handle located at a first side of said looped portion and a second handle located at an opposite and second side of said looped portion.

6. The wearable belt support device according to claim 1, further comprising means for selectively disengaging said shoulder strap portion at said first and second ends from said looped portion, said looped portion further including a first pair of receiving means located at said further selected circumferential locations, a second pair of receiving means being located at yet additional selected circumferential locations, a selected one of said first and second pairs of receiving means being capable of being resecurably engaged by engaging means located on said first and second ends of said shoulder strap portion.

7. The wearable belt support device according to claim 1, further comprising said shoulder strap portion extending in a diagonal fashion across a selected shoulder of the assisting individual.

8. The wearable belt support device according to claim 1, further comprising a third neck support portion encircling a neck of the assisting individual, a connecting portion extending from said neck support portion and engaging an intermediate location along said second shoulder strap portion.

9. A wearable belt support device for use by a first individual in providing guiding support to a second individual, said support device comprising:

a looped portion encircling a waist of the first individual, said looped portion including a width adjustment means;

at least one hand hold portion extending from a selected circumferential location along said looped portion;

a shoulder strap portion extending upwardly from said looped portion and over a shoulder of the first individual, said shoulder strap portion securing at first and second ends to further selected circumferential locatioins along said looped portion, said shoulder strap portion including a height adjustment means; and means for selectively disengaging said shoulder strap portion at said first and second ends from said looped portion, said looped portion further including a first pair of receiving means located at said further selected circumferential locations, a second pair of receiving means being located at yet additional selected circumferential locations, a selected one of said first and second pairs of receiving means being capable of being resecurably engaged by engaging means located on said first and second ends of said shoulder strap portion, said engaging means comprising snap engagement portions situated upon said shoulder strap, said first and second pairs of said receiving means further comprising snap receiving portions situated upon said looped portion;

wherein said hand hold portion is grasped by the second individual to facilitate the first individual in providing the guiding support.

10. A wearable belt support device for use in assisting a handicapped individual, said support device comprising:

a looped portion encircling a waist of an assisting individual, said looped portion including a width adjustment means;

at least one hand hold portion extending from a selected circumferential location along said looped portion;

a shoulder strap portion extending upwardly from said looped portion and over a shoulder of the assisting individual, said shoulder strap portion securing at first and second ends to further selected circumferential locations alond said looped portion, said shoulder strap portion including a height adjustment means;

a neck support portion encircling a neck of the assisting individual, a connecting portion extending from said neck support portion and engaging an intermediate location along said shoulder strap portion; and wherein said hand hold portion is grasped by an assisted individual to facilitate the assisting individual in providing ambulatory support.

11. The wearable belt support device according to claim 10, wherein said looped portion, said shoulder strap portion and said neck support portion are all further constructed of a flexible leather material.

12. The wearable belt support device according to claim 10, said neck support portion further comprising a first interengaging end and a second interengaging end, adjustment means being provided for securing said first interengaging end along selected locations of said second interengaging end.

13. The wearable belt support device according to claim 10, further comprising means for releasably securing said connecting portion of said neck support portion from said shoulder strap portion.

14. The wearable belt support device according to claim 10, wherein said looped portion, said shoulder strap portion and said neck support portion are all further constructed of a flexible vinyl material.

* * * * *